US008368293B2

(12) United States Patent
Mitsuda et al.

(10) Patent No.: US 8,368,293 B2
(45) Date of Patent: Feb. 5, 2013

(54) SPARK PLUG AND METHOD OF MANUFACTURING THE SAME

(75) Inventors: Shinya Mitsuda, Inuyama (JP); Takehito Kuno, Ichinomiya (JP); Takaaki Kikai, Ama (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 13/337,897

(22) Filed: Dec. 27, 2011

(65) Prior Publication Data

US 2012/0187820 A1 Jul. 26, 2012

(30) Foreign Application Priority Data

Jan. 7, 2011 (JP) ..... 2011-1796
Dec. 12, 2011 (JP) ..... 2011-270993

(51) Int. Cl.
*H01T 13/32* (2006.01)
*H01T 21/02* (2006.01)

(52) U.S. Cl. ..... 313/141; 445/7

(58) Field of Classification Search ..... 313/118–143; 445/7; 252/71

See application file for complete search history.

(56) References Cited

U.S. PATENT DOCUMENTS

2010/0264801 A1* 10/2010 Tanaka et al. ..... 313/141

FOREIGN PATENT DOCUMENTS

JP 2009-037750 A 2/2009

* cited by examiner

*Primary Examiner* — Joseph L Williams
(74) *Attorney, Agent, or Firm* — Leason Ellis LLP

(57) ABSTRACT

A spark plug provides a reduced production cost by forming a tip from a metallic material containing Ni that exhibits excellent erosion resistance. The spark plug comprises an insulator having an axial hole extending in an axial direction; a center electrode inserted into the axial hole at a front end thereof; a metallic shell provided around the insulator; a ground electrode whose proximal end portion is fixed to a front end portion of the metallic shell; and a tip bonded to a distal end portion of the ground electrode such that a spark discharge gap is formed between the tip and a front end portion of the center electrode. The tip is formed of a metallic material containing Ni in an amount of 93 mass % or more, and has a Vickers hardness of 163 Hv or less.

10 Claims, 4 Drawing Sheets

SPARK PLUG AND METHOD OF MANUFACTURING THE SAME

CROSS-REFERENCE TO RELATED PATENT APPLICATIONS

This application claims the benefit of Japanese Patent Application No. 2011-1796, filed Jan. 7, 2011; and No. 2011-270993, filed Dec. 12, 2011, all of which are incorporated by reference herein.

FIELD OF THE INVENTION

The present invention relates to a spark plug used for an internal combustion engine or the like, and to a method for producing the spark plug.

BACKGROUND OF THE INVENTION

A spark plug used for a combustion apparatus of an internal combustion engine or the like includes, for example, a center electrode extending in an axial direction, an insulator provided around the center electrode, a circular columnar metallic shell assembled outside of the insulator, and a ground electrode whose proximal end portion is bonded to a front end portion of the metallic shell. The ground electrode is bent at an approximately central portion thereof such that its distal end portion faces the front end portion of the center electrode, whereby a spark discharge gap is formed between the front end portion of the center electrode and the distal end portion of the ground electrode.

In recent years, there has been disclosed a technique for improving ignition performance by providing a tip formed of a noble metal alloy on a portion at the distal end of the ground electrode, the portion forming the aforementioned spark discharge gap (see, for example, Japanese Patent Application Laid-Open (kokai) No. 2009-37750).

SUMMARY OF THE INVENTION

Problems to be Solved by the Invention

However, employment of a noble metal alloy, which is expensive, may cause an increase in production cost. Therefore, a conceivable measure for reducing production cost is to form the aforementioned tip from an Ni alloy containing nickel (Ni) as a main component, which alloy is relatively inexpensive.

However, an Ni alloy generally exhibits erosion resistance lower than that of a noble metal alloy. Therefore, when the tip is formed from an Ni alloy, the tip may be rapidly eroded.

When the tip is eroded, and the size of a discharge gap is increased, discharge may occur at a portion other than a regular discharge gap. Thus, there is a concern that provision of the tip may fail to sufficiently improve ignition performance.

The present invention has been conceived to solve the aforementioned problems, and an object of the invention is to provide a spark plug whose production cost is reduced by forming a tip from a metallic material containing Ni as a main component, and which exhibits excellent erosion resistance. Another object of the present invention is to provide a method for producing the spark plug.

Means for Solving the Problems

Configurations suitable for achieving the aforementioned objects will next be described in itemized form. If needed, actions and effects peculiar to the configurations will be described additionally.

Configuration 1: a spark plug comprising:

a tubular insulator having an axial hole extending therethrough in a direction of an axis;

a center electrode inserted into the axial hole at a front end thereof;

a tubular metallic shell provided around the insulator;

a ground electrode whose proximal end portion is fixed to a front end portion of the metallic shell; and a tip which is bonded to a distal end portion of the ground electrode such that a gap is formed between the tip and a front end portion of the center electrode, the spark plug being characterized in that the tip is formed of a metallic material containing nickel (Ni) in an amount of 93 mass % or more; and the tip has a Vickers hardness of 163 Hv or less.

According to the above-described configuration 1, since the tip is formed of a metallic material containing Ni as a main component, production cost can be reduced as compared with the case where the tip is formed of a noble metal alloy.

When the tip is formed of a metallic material containing Ni as a main component, there is a concern that the tip would exhibit insufficient erosion resistance. However, according to the above-described configuration 1, the tip has a hardness of 163 Hv or less, and the strain of crystal grains in the metallic material forming the tip is suppressed. Therefore, heat is smoothly conducted through the tip; i.e., the thermal conductivity of the tip can be improved. Since the tip is formed of a metallic material containing Ni (which exhibits excellent thermal conductivity) in an amount of 93 mass % or more, the tip exhibits further improved thermal conductivity. That is, since the tip has a hardness of 163 Hv or less, and the tip is formed of a metallic material containing Ni in an amount of 93 mass % or more, the tip exhibits dramatically improved thermal conductivity. Therefore, the erosion resistance of the tip can be dramatically improved, and thus the effect of improving ignition performance through provision of the tip can be maintained over a long period of time.

Configuration 2: a spark plug of the present configuration is characterized in that, in the above configuration 1, compressive residual stress is applied to a surface of the tip, the surface forming the gap.

According to the above-described configuration 2, compressive residual stress is applied to a surface of the tip, the surface (discharge surface) forming the gap. Therefore, even when vibration is applied to the tip in association with operation of an internal combustion engine or the like, breakage (e.g., cracking) is less likely to occur at the discharge surface. Thus, there can be more reliably prevented a rapid increase in the size of the gap due to breakage at the discharge surface. Therefore, an increase in discharge voltage can be suppressed, and rapid erosion of the center electrode or the tip, which would otherwise occur upon spark discharge, can be suppressed. In addition, spark discharge at a portion other than the gap can be prevented, and the effect of improving ignition performance through provision of the tip can be more reliably attained.

Configuration 3: a spark plug of the present configuration is characterized in that, in the above configuration 1 or 2, the distance, as measured along the center axis of the ground electrode, between the distal end of the ground electrode and the tip is adjusted to 1.5 mm or less; and the ground electrode has a Vickers hardness of 90 Hv or more.

From the viewpoint that inhibition of flame kernel growth by the ground electrode is suppressed for further improvement of ignition performance, desirably, the tip is bonded to a portion of the ground electrode in the vicinity of the distal end thereof, and the distance, as measured along the center axis of the ground electrode, between the distal end of the ground electrode and the tip is reduced to a minimum possible level. In general, the ground electrode is formed through cutting of a wire rod formed of a specific metal. However, in the case where warpage occurs at end portions of the ground electrode in association with cutting, when the tip is bonded to a portion of the ground electrode in the vicinity of the distal end thereof, the bonding strength of the tip to the ground electrode may be lowered. When the bonding strength is lowered, oxide scale is likely to be formed at the bonding boundary between the ground electrode and the tip, and the oxide scale may inhibit thermal conduction from the tip to the ground electrode.

In this regard, according to the above-described configuration 3, since the ground electrode has a hardness of 90 Hv or more, warpage of the ground electrode, which would otherwise occur in association with cutting, can be more reliably prevented. Therefore, even when the tip is bonded to the ground electrode such that the distance between the distal end of the ground electrode and the tip is 1.5 mm or less for the purpose of improving ignition performance, the bonding strength between the ground electrode and the tip can be increased, and thus formation of oxide scale at the bonding boundary between them can be effectively prevented. Therefore, the thermal conductivity from the tip to the ground electrode can be improved, and the erosion resistance of the tip can be further improved.

Configuration 4: a spark plug of the present configuration is characterized in that, in any of the above configurations 1 to 3, the ground electrode is formed of a metallic material containing Ni as a main component; and at least one of the tip and the ground electrode contains at least one species selected from among silicon (Si), manganese (Mn), and aluminum (Al).

As used herein, the term "main component" of a material refers to a component which is contained in the material in the largest amount by mass among all components (the same shall apply hereinafter).

According to the above-described configuration 4, since the ground electrode is formed of a metallic material containing Ni as a main component, the thermal conductivity of the ground electrode can be further improved, and thus the erosion resistance of the tip can be further improved.

In addition, according to the above-described configuration 4, since the tip or the ground electrode contains Si, Mn, or Al, the oxidation resistance of the tip or the ground electrode can be improved. Therefore, impairment of the thermal conductivity of the tip or the ground electrode, which would otherwise occur due to oxidation, can be suppressed, and thus the erosion resistance of the tip can be further improved.

Configuration 5: a spark plug of the present configuration is characterized in that, in any of the above configurations 1 to 4, the ground electrode is formed of a metallic material containing nickel as a main component; and at least one of the tip and the ground electrode contains Si in an amount of 0.5 mass % to 1.3 mass %, Mn in an amount of 0.1 mass % to 1.1 mass %, and Al in an amount of 0.01 mass % to 1.00 mass %.

According to the above-described configuration 5, the actions and effects provided by the above-described configuration 4 are more reliably achieved.

Configuration 6: a spark plug of the present configuration is characterized in that, in any of the above configurations 1 to 5, at least one of the tip and the ground electrode contains one or more rare earth elements.

According to the above-described configuration 6, since the tip or the ground electrode contains one or more rare earth elements, grain growth in the metallic material forming the tip or the ground electrode can be suppressed. Therefore, occurrence of breakage, cracking, etc. in the tip or the ground electrode can be effectively prevented.

Configuration 7: a spark plug of the present configuration is characterized in that, in the above configuration 6, the total amount of the rare earth element(s) is 0.05 mass % to 0.25 mass %.

According to the above-described configuration 7, the actions and effects provided by the above-described configuration 6 are more reliably achieved.

Configuration 8: a method for producing a spark plug as recited in any of the above-described configurations 1 to 7, characterized by comprising:

a bonding step of bonding the tip to the ground electrode through resistance welding, wherein, in the bonding step, the tip is bonded to the ground electrode by bringing one end surface of the tip into contact with the ground electrode, and applying electricity to the tip while applying pressure to the tip from the side of the opposite end surface toward the ground electrode; and a side surface of the tip located between the one end surface and the opposite end surface is exposed to air at least during application of electricity to the tip.

According to the above-described configuration 8, since the tip is welded to the ground electrode while a side surface thereof is exposed to air, the tip can be sufficiently heated. Therefore, as in the case where annealing is carried out, the hardness of the tip can be lowered. That is, according to the above-described configuration 8, the hardness of the tip can be readily lowered to 163 Hv or less through the bonding step, without providing a step of lowering the hardness of the tip. Therefore, productivity can be improved.

Configuration 9: a spark plug production method of the present configuration is characterized in that, in the above-described configuration 8, the tip has a Vickers hardness of 100 Hv or more as measured after the bonding step.

According to the above-described configuration 9, since the tip has a hardness of 100 Hv or more as measured after the bonding step, scratching of the tip can be more reliably prevented upon, for example, carrying of the spark plug.

Configuration 10: a spark plug production method of the present configuration is characterized in that, in the above-described configuration 8 or 9, the method further comprises a bending step of bending the ground electrode by supporting, with a rod-like supporting jig, a surface of the ground electrode on the side of the center electrode, and pressing the ground electrode from the surface opposite the surface on the side of the center electrode, wherein the ground electrode has a Vickers hardness of 150 Hv or less.

According to the above-described configuration 10, since the ground electrode has a hardness of 150 Hv or less, breakage of the supporting jig in the bending step can be more reliably prevented. Therefore, productivity can be further improved.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Mode for Carrying Out the Invention

Figure 1:
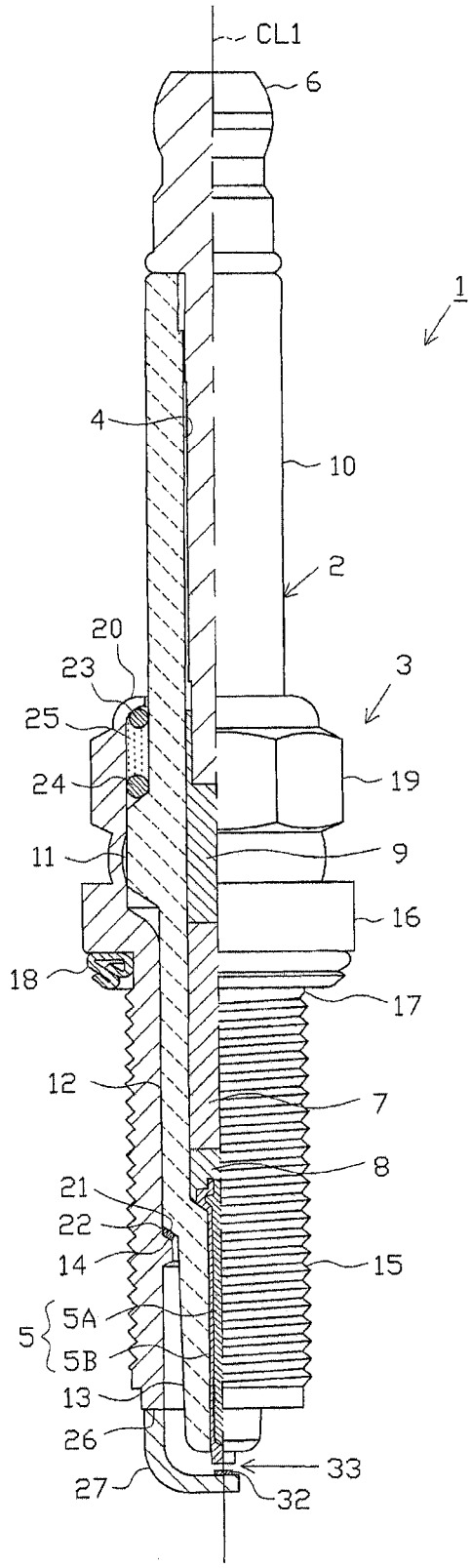
FIG. 1 is a partially sectioned front view of the configuration of a spark plug.

One embodiment will next be described with reference to the drawings. FIG. 1 is a partially sectioned front view showing a spark plug 1. Notably, in FIG. 1, the direction of an axis CL1 of the spark plug 1 is referred to as the vertical direction. In the following description, the lower side of the spark plug 1 in FIG. 1 is referred to as the front end side of the spark plug 1, and the upper side as the rear end side.

The spark plug 1 includes, for example, a tubular insulator 2, and a tubular metallic shell 3, which holds the insulator 2 therein.

The insulator 2 is formed from alumina or the like through firing, as well known in the art. The insulator 2, as viewed externally, includes a rear trunk portion 10 formed on the rear end side; a large-diameter portion 11, which is located frontward of the rear trunk portion 10 and projects radially outward; an intermediate trunk portion 12, which is located frontward of the large-diameter portion 11 and is smaller in diameter than the large-diameter portion 11; and a leg portion 13, which is located frontward of the intermediate trunk portion 12 and is smaller in diameter than the intermediate trunk portion 12. The large-diameter portion 11, the intermediate trunk portion 12, and the greater portion of the leg portion 13 of the insulator 2 are accommodated within the metallic shell 3. A tapered, stepped portion 14 is formed at a connection portion between the intermediate trunk portion 12 and the leg portion 13. The insulator 2 is seated on the metallic shell 3 at the stepped portion 14.

Furthermore, the insulator 2 has an axial hole 4 extending therethrough along the axis CL1. A center electrode 5 is fixedly inserted into a front end portion of the axial hole 4. The center electrode 5 includes an inner layer 5A formed of copper or a copper alloy, and an outer layer 5B formed of an Ni alloy containing nickel (Ni) as a main component. The center electrode 5 has a rod-like shape (circular columnar shape) as a whole, and the front end portion thereof projects from the front end of the insulator 2.

Also, a terminal electrode 6 is fixedly inserted into a rear end portion of the axial hole 4 and projects from the rear end of the insulator 2.

A circular columnar resistor 7 is disposed within the axial hole 4 between the center electrode 5 and the terminal electrode 6. Opposite end portions of the resistor 7 are electrically connected to the center electrode 5 and the terminal electrode 6, respectively, via electrically conductive glass seal layers 8 and 9.

The metallic shell 3 is formed into a tubular shape from a low-carbon steel or a like metal. The metallic shell 3 has, on its outer circumferential surface, a threaded portion (externally threaded portion) 15 adapted to mount the spark plug 1 to a combustion apparatus (e.g., an internal combustion engine or a fuel cell reformer). Also, the metallic shell 3 has, on its outer circumferential surface, a seat portion 16 which is located rearward of the threaded portion 15 and projects radially outward. A ring-like gasket 18 is fitted to a screw neck 17 at the rear end of the threaded portion 15. Furthermore, the metallic shell 3 has, near the rear end thereof, a tool engagement portion 19 having a hexagonal cross section and allowing a tool (e.g., a wrench) to be engaged therewith when the metallic shell 3 is to be mounted to the combustion apparatus. Also, the metallic shell 3 has, at a rear end thereof, a crimp portion 20 which is bent radially inward.

Also, a tapered, stepped portion 21 is formed on the inner circumferential surface of the metallic shell 3 so as to receive the insulator 2, which butts against the stepped portion 21. The insulator 2 is inserted frontward into the metallic shell 3 from the rear end of the metallic shell 3. In a state in which the stepped portion 14 of the insulator 2 butts against the stepped portion 21 of the metallic shell 3, a rear-end opening portion of the metallic shell 3 is crimped radially inward; i.e., the aforementioned crimp portion 20 is formed, whereby the insulator 2 is fixed to the metallic shell 3. An annular sheet packing 22 intervenes between the stepped portion 14 of the insulator 2 and the stepped portion 21 of the metallic shell 3. This retains gas tightness of a combustion chamber and prevents outward leakage of fuel gas which enters the clearance between the inner circumferential surface of the metallic shell 3 and the leg portion 13 of the insulator 2, which is exposed to the combustion chamber.

Furthermore, in order to ensure gas tightness which is established by crimping, annular ring members 23 and 24 are provided between the metallic shell 3 and the insulator 2 in a region near the rear end of the metallic shell 3, and a space between the ring members 23 and 24 is filled with powder of talc 25. That is, the metallic shell 3 holds the insulator 2 via the sheet packing 22, the ring members 23 and 24, and the talc 25.

Figure 2:
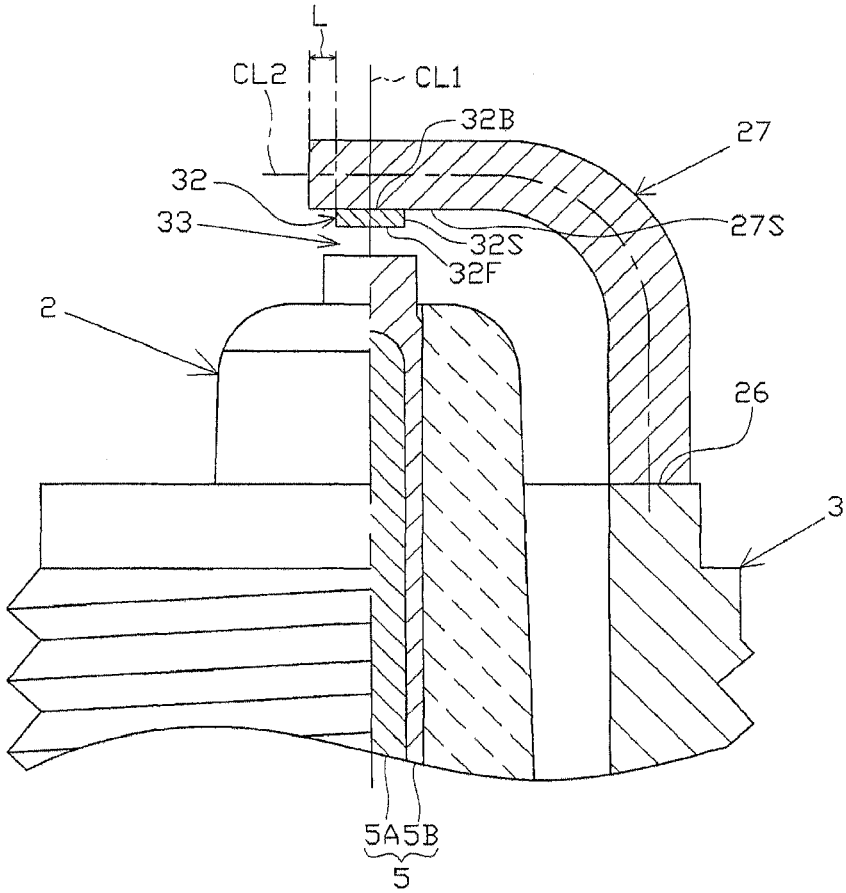
FIG. 2 is an enlarged, partially sectioned front view of the configuration of a front end portion of the spark plug.

As shown in FIG. 2, a rod-like ground electrode 27 is bonded to the front end portion 26 of the metallic shell 3 such that the ground electrode 27 is bent at an approximately central portion thereof. Also, an end surface 32B of a circular columnar tip 32 is bonded to a side surface 27S of the ground electrode 27, the surface 27S being located on the side of the center electrode 5. In the present embodiment, the tip 32 is bonded to the ground electrode 27 such that it is located in the vicinity of the distal end of the ground electrode 27. Specifically, the distance L, as measured along the center axis CL2 of the ground electrode 27, between the distal end of the ground electrode 27 and the tip 32 is adjusted to 1.5 mm or less. A spark discharge gap 33 is formed between the front end of the center electrode 5 and an end surface 32F of the tip 32, and spark discharge occurs at the spark discharge gap 33 in a direction generally along the axis CL1.

In the present embodiment, the tip 32 is formed of a metallic material containing Ni in an amount of 93 mass % or more. Also, the tip 32 contains silicon (Si) in an amount of 0.5 mass % to 1.3 mass %, manganese (Mn) in an amount of 0.1 mass % to 1.1 mass %, and aluminum (Al) in an amount of 0.01 mass % to 1.00 mass %. In addition, the tip 32 contains one or more rare earth elements, and the total amount of the rare earth element(s) is 0.05 mass % to 0.25 mass %.

Examples of the rare earth element include yttrium (Y); lanthanoids such as lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), and lutetium (Lu); and scandium (Sc).

In the present embodiment, the tip 32 has a Vickers hardness of 100 Hv to 163 Hv. The hardness of the tip 32 may be measured at, for example, a center portion of a cross section of the tip 32 including the center axis thereof.

The ground electrode 27 is formed of an alloy containing Ni as a main component, and also containing Si in an amount of 0.5 mass % to 1.3 mass %, Mn in an amount of 0.1 mass % to 1.1 mass %, and Al in an amount of 0.01 mass % to 1.00 mass %. In addition, the ground electrode 27 contains one or more rare earth elements, and the total amount of the rare earth element(s) is 0.05 mass % to 0.25 mass.

Furthermore, in the present embodiment, the spark plug is configured such that compressive residual stress is applied to the end surface 32F (the surface forming the spark discharge gap 33) of the tip 32.

The ground electrode 27 has a Vickers hardness of 90 Hv to 150 Hv. The hardness of the ground electrode 27 is measured at a portion other than the following portions: a portion which is processed after bonding of the ground electrode 27 to the metallic shell 3 (i.e., a portion whose hardness may change through processing), and a portion whose hardness may change through bonding. Specifically, the hardness of the ground electrode 27 is not measured at a bent portion thereof, since, as described below, the ground electrode 27 is bent toward the center electrode 5 through a bending process after having been bonded to the metallic shell 3. Also, for example, the hardness of the ground electrode 27 is not measured at a portion whose hardness may change through bonding of the tip 32 (e.g., a portion which is located 1.0 mm or less distant from the tip 32).

Next will be described a method for producing the spark plug 1 having the aforementioned configuration.

Firstly, a metallic shell 3 is produced in advance. Specifically, a circular columnar metallic material (e.g., an iron material or a stainless steel material) is shaped into a rough form through, for example, cold forging, and also a through hole is formed. Thereafter, the resultant product is subjected to cutting, to thereby produce a metallic shell intermediate having a shape of interest.

Separately from the metallic shell intermediate, a straight rod-like ground electrode 27 formed of an Ni alloy is produced. Specifically, an Ni alloy rod is subjected to cold forging (wire drawing), to thereby gradually thin the rod. The hardness of the alloy rod is adjusted to 90 Hv or more through cold forging. After having been sufficiently thinned, the alloy rod is cut into pieces having a specific length, to thereby produce the straight rod-like ground electrode 27 having a hardness of 90 Hv or more. In order to lower the hardness of the ground electrode 27, the ground electrode 27 may be subjected to thermal treatment (annealing). However, the thermal treatment time or the heating temperature must be regulated so that the hardness of the ground electrode 27 is lowered to less than 90 Hv.

Subsequently, the thus-produced ground electrode 27 is bonded to a front end surface of the metallic shell intermediate through resistance welding. During resistance welding, so-called "weld flash" is generated. Therefore, after removal of the "weld flash," a threaded portion 15 is formed at a specific portion of the metallic shell intermediate through rolling, to thereby produce a metallic shell 3 to which the ground electrode 27 has been welded.

Then, the metallic shell 3 to which the ground electrode 27 has been welded is plated with zinc or Ni. The surface of the thus-plated metallic shell may be further subjected to chromate treatment for the purpose of improving corrosion resistance.

Separately from the aforementioned metallic shell 3, an insulator 2 is produced through molding. For example, a tubular molded product is produced through rubber press molding of a granular base prepared from a powdery raw material containing, for example, alumina (main component) and a binder. The resultant molded product is subjected to grinding and shaping, and the thus-shaped product is fired in a firing furnace, to thereby produce the insulator 2.

Separately from the aforementioned metallic shell 3 or insulator 2, a center electrode 5 is produced. Specifically, the center electrode 5 is produced through forging of an Ni alloy rod whose center portion is provided with, for example, a copper alloy for the purpose of improving heat radiation performance.

In addition, a tip 32 is produced in advance. Specifically, an alloy material containing Ni in an amount of 93 mass % or more, and containing Si, Mn, and a rare earth element in specific amounts is provided, and the alloy material is subjected to hot forging and hot rolling (caliber rolling), followed by wire drawing, to thereby produce a rod-like material. The rod-like material is cut into pieces each having a specific length, to thereby produce the tip 32. In the present embodiment, the tip 32 is produced as described above. However, the tip 32 may be produced through the following procedure: a thin alloy rod prepared through wire drawing in advance is cut into pieces so that the length of each piece is greater than the aforementioned specific length, and the piece is pressed into a mold for molding. The thus-produced tip 32 has a relatively high hardness (e.g., 200 Hv or more). In association with wire drawing, a relatively high tensile stress (e.g., about 200 MPa) remains in the tip 32 along its center axis.

Subsequently, the above-produced insulator 2 and center electrode 5, a resistor 7, and a terminal electrode 6 are fixedly sealed by means of glass seal layers 8 and 9. The glass seal layers 8 and 9, which are generally prepared from a mixture of borosilicate glass and metal powder, are injected into the axial hole 4 of the insulator 2 so as to sandwich the resistor 7, followed by firing in a firing furnace under pressing by means of the terminal electrode 6 provided on the rear end side. In parallel therewith, a glaze layer may be formed on the surface of a rear trunk portion 10 of the insulator 2 through firing. Alternatively, the glaze layer may be formed in advance.

Thereafter, the above-produced insulator 2 having the center electrode 5 and the terminal electrode 6 is fixed to the metallic shell 3 having the ground electrode 27. More specifically, the insulator 2 is inserted into the metallic shell 3, and a rear-end opening portion of the metallic shell 3, which has a relatively small thickness, is crimped radially inward; i.e., the aforementioned crimp portion 20 is formed, whereby the insulator 2 is fixed to the metallic shell 3.

Figure 3:
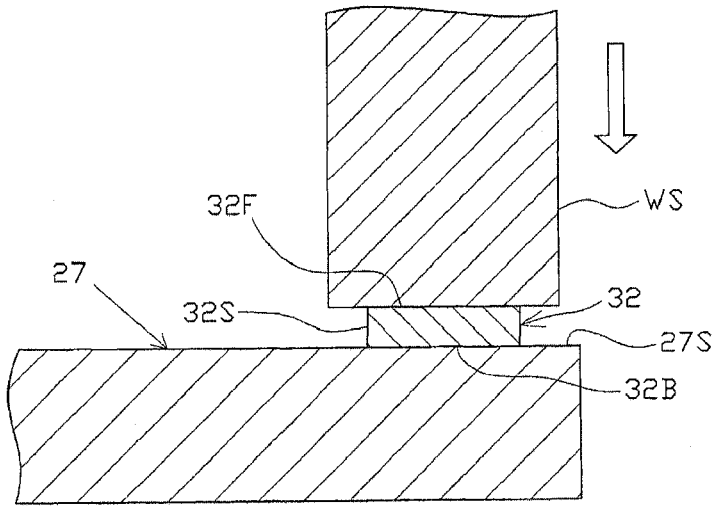
FIG. 3 is an enlarged schematic cross-sectional view of a ground electrode, a tip, etc. in a bonding step.

Subsequently, in the bonding step, the tip 32 is bonded to a distal end portion of the ground electrode 27. Specifically, as shown in FIG. 3, an end surface 32B of the tip 32 is brought into contact with a side surface 27S (on the side of the center electrode 5) of the ground electrode 27, and a specific welding electrode rod WS is brought into contact with an end surface 32F of the tip 32. In this case, the tip 32 is disposed at a portion 1.5 mm or less distant from the distal end of the ground electrode 27. Then, while the welding electrode rod WS is moved toward the ground electrode 27; i.e., the tip 32 is pressed with the welding electrode rod WS at a specific pressure, a specific current is caused to flow from the welding electrode rod WS to the tip 32. Thus, the tip 32 is bonded to the ground electrode 27.

At least during application of current to the tip 32, a side surface 32S of the tip 32 located between the end surface 32B and the end surface 32F is exposed to air without being supported by means of a jig or the like. When the tip 32 is welded to the ground electrode while the side surface 32S is exposed to air without being supported, the tip 32 is sufficiently heated. Therefore, as in the case where annealing is carried out, the hardness of the tip 32 is lowered to 160 Hv or less. Notably, the tip 32 has a hardness of 100 Hv or more as measured after the bonding step.

Through regulation of the pressing load of the welding electrode rod WS to the tip 32, or the current applied to the tip 32, the tensile stress remaining in the tip 32 is removed, and compressive residual stress is applied to the end surface 32F of the tip 32.

Figure 4A:
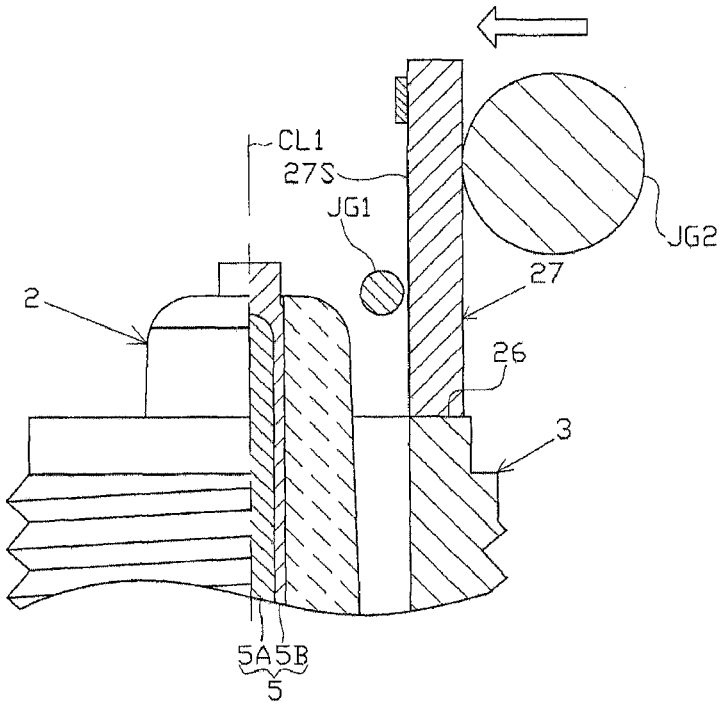
FIG. 4A is an enlarged schematic view of the ground electrode, etc. in a bending step.
Figure 4B:
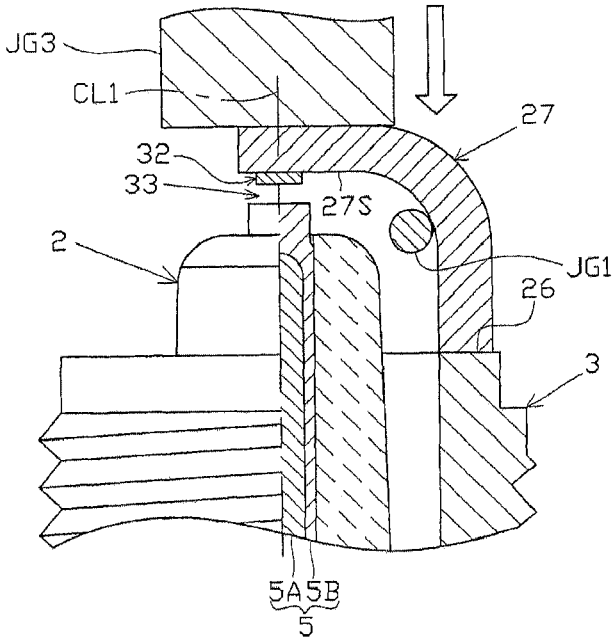
FIG. 4B is an enlarged schematic view of the ground electrode, etc. in the bending step.

Subsequently, in the bending step, the ground electrode 27 is bent toward the center electrode 5. Specifically, as shown in FIG. 4A, a rod-like supporting jig JG1 is disposed between the center electrode 5 and the ground electrode 27. Then, the side surface 27S of the ground electrode 27 is supported by means of the supporting jig JG1, and the surface of the ground electrode 27 opposite the side surface 27S is pressed by means of a specific pressing jig JG2, to thereby bend the ground electrode 27 obtusely. Next, as shown in FIG. 4B, the distal end portion of the ground electrode 27 is pressed along the axis CL1 by means of a specific pressing jig JG3, to thereby bend the ground electrode 27 at a generally right angle, and to form a spark discharge gap 33 between the center electrode 5 and the tip 32. Finally, the size of the spark discharge gap 33 is adjusted. Thus, the aforementioned spark plug 1 is produced.

As described above in detail, according to the present embodiment, since the tip 32 is formed of a metallic material containing Ni as a main component, production cost can be reduced as compared with the case where the tip 32 is formed of a noble metal alloy.

The spark plug according to the present embodiment is configured such that the tip 32 has a hardness of 163 Hv or less, and the strain of crystal grains in the metallic material forming the tip 32 is suppressed. Therefore, heat is smoothly conducted through the tip 32; i.e., the thermal conductivity of the tip 32 can be improved. Since the tip 32 is formed of a metallic material containing Ni (which exhibits excellent thermal conductivity) in an amount of 93 mass % or more, the tip 32 exhibits further improved thermal conductivity. That is, since the tip 32 has a hardness of 163 Hv or less and is formed of a metallic material containing Ni in an amount of 93 mass % or more, the tip 32 exhibits dramatically improved thermal conductivity. Therefore, the erosion resistance of the tip 32 can be dramatically improved, and thus the effect of improving ignition performance through provision of the tip 32 can be maintained over a long period of time.

Furthermore, the spark plug according to the present embodiment is configured such that compressive residual stress is applied to the end surface 32F of the tip 32. Therefore, even when vibration is applied to the tip 32 in association with operation of an internal combustion engine or the like, breakage (e.g., cracking) is less likely to occur at the end surface 32F. Thus, there can be more reliably prevented a rapid increase in the size of the spark discharge gap 33 due to breakage at the end surface 32F. Therefore, an increase in discharge voltage can be suppressed, and rapid erosion of the center electrode 5 or the tip 32, which would otherwise occur upon spark discharge, can be suppressed. In addition, spark discharge at a portion other than the spark discharge gap 33 can be prevented, and the effect of improving ignition performance through provision of the tip 32 can be more reliably attained.

Moreover, since the tip 32 has a hardness of 100 Hv or more, scratching of the tip 32 can be more reliably prevented upon, for example, carrying of the spark plug 1.

Furthermore, since the ground electrode 27 has a hardness of 90 Hv or more, warpage of the ground electrode 27, which would otherwise occur in association with cutting upon production of the ground electrode 27, can be more reliably prevented. Therefore, even when the tip 32 is bonded to the ground electrode 27 such that the distance between the distal end of the ground electrode 27 and the tip 32 is 1.5 mm or less for the purpose of improving ignition performance, the bonding strength between the ground electrode 27 and the tip 32 can be increased, and thus formation of oxide scale at the bonding boundary between them can be effectively prevented. Therefore, the thermal conductivity from the tip 32 to the ground electrode 27 can be improved, and the erosion resistance of the tip 32 can be further improved.

In addition, since the ground electrode 27 has a hardness of 150 Hv or less, breakage of the supporting jig JG1 in the bending step can be more reliably prevented. Therefore, productivity can be further improved.

Since the tip 32 or the ground electrode 27 contains Si, Mn, and Al in specific amounts, respectively, the oxidation resistance of the tip 32 or the ground electrode 27 can be improved. Therefore, impairment of the thermal conductivity of the tip 32 or the ground electrode 27, which would otherwise occur due to oxidation, can be suppressed, and thus the erosion resistance of the tip 32 can be further improved.

Furthermore, the tip 32 or the ground electrode 27 contains one or more rare earth elements, and the total amount of the rare earth element(s) is 0.05 mass % to 0.25 mass %. Therefore, grain growth in the metallic material forming the tip 32 or the ground electrode 27 can be suppressed, and thus occurrence of breakage, cracking, etc. in the tip 32 or the ground electrode 27 can be effectively prevented.

In order to confirm the actions and effects achieved by the above-described embodiment, a plurality of spark plug samples including tips having different hardnesses were produced, and each sample was subjected to an erosion resistance evaluation test and a scratch resistance evaluation test.

The erosion resistance evaluation test was carried out as follows. Specifically, each sample was attached to a specific chamber, and the interior of the chamber was maintained in an air atmosphere. The pressure in the chamber was adjusted to 0.4 MPa, and discharge of the sample was carried out for 20 hours at an applied voltage frequency of 100 Hz (i.e., 6,000 times/minute). After the elapse of 20 hours, an increase in the size of the spark discharge gap (hereinafter will be referred to as "gap increase") was measured. A sample in which the gap increase was less than 0.10 mm was evaluated "Good" because it exhibits good erosion resistance. In contrast, a sample in which the gap increase was 0.10 mm or more was evaluated "Poor" because it exhibits poor erosion resistance.

The scratch resistance evaluation test was carried out as follows. Specifically, by means of a specific autograph, a quadrangular columnar metallic piece formed of specific super steel was pressed at a load of 50 N or 70 N onto the end surface of the tip facing the center electrode. After application of a load, the end surface of the tip was observed for determining whether or not scratches were generated on the end surface. A sample in which no scratches were generated on the tip even under application of a load of 70 N was evaluated "Excellent" because it exhibits excellent scratch resistance, whereas a sample in which scratches were generated on the tip under application of a load of 70 N, but no scratches were generated on the tip under application of a load of 50 N was evaluated "Good" because it exhibits good scratch resistance.

In contrast, a sample in which scratches were generated on the tip under application of a load of 50 N was evaluated "Poor" because it exhibits poor scratch resistance.

Table 1 shows the results of the erosion resistance evaluation test and the scratch resistance evaluation test. Also, Table 1 shows data of gap increase, as well as data of the erosion volume of each tip during the erosion resistance evaluation test. In each sample, the tip was formed from an alloy containing Ni in 93 mass % or more. The outer diameter of the tip was adjusted to 1.5 mm; the thickness of the ground electrode was adjusted to 1.5 mm; and the width of the ground electrode was adjusted to 2.8 mm. The tip was bonded to the ground electrode at a position 1.5 mm distant from the distal end of the ground electrode (in the tests described below, the sizes of the tip and the ground electrode were the same as those described above). The hardness of the tip was varied by controlling the heating conditions of the tip during welding. For example, when the hardness of the tip was increased to a relatively high level, a side surface of the tip was supported by means of a metallic jig, and welding was carried out in the state where heat of the tip was readily released through the jig.

TABLE 1

| Tip Hardness (Hv) | Gap Increase (mm) | Erosion Volume ($mm^3$) | Evaluation of Erosion resistance | Evaluation of Scratch Resistance |
|---|---|---|---|---|
| 85 | 0.05 | 0.162 | Good | Good |
| 94 | 0.06 | 0.180 | Good | Good |
| 100 | 0.06 | 0.195 | Good | Excellent |
| 105 | 0.05 | 0.169 | Good | Excellent |
| 113 | 0.05 | 0.184 | Good | Excellent |
| 128 | 0.06 | 0.190 | Good | Excellent |
| 142 | 0.07 | 0.196 | Good | Excellent |
| 151 | 0.08 | 0.202 | Good | Excellent |
| 160 | 0.08 | 0.204 | Good | Excellent |
| 163 | 0.08 | 0.223 | Good | Excellent |
| 169 | 0.10 | 0.240 | Poor | Excellent |
| 181 | 0.11 | 0.249 | Poor | Excellent |

As shown in Table 1, a sample including a tip having a hardness of 163 Hv or less exhibited a gap increase of less than 0.10 mm, and the sample was found to have excellent erosion resistance. Conceivably, this is attributed to the fact that the thermal conductivity of the tip is dramatically improved by a synergistic effect of formation of the tip from a metallic material containing a large amount of Ni, which exhibits excellent thermal conductivity, and suppression of strain of crystal grains in the metallic material forming the tip by lowering the hardness of the tip to a relatively low level.

It was also found that a sample including a tip having a hardness of 100 Hv or more exhibited excellent erosion resistance; i.e., no scratches were generated on the tip even under application of a very large load of 70 N.

The aforementioned test data indicate that, in order to improve erosion resistance, it is preferred to form a tip from an alloy containing Ni in an amount of 93 mass % or more, and to adjust the hardness of the tip to 163 Hv or less.

The test data also indicate that, in order to improve the scratch resistance of a tip, it is preferred to adjust the hardness of the tip to 100 Hv or more.

Next, there were produced ground electrode samples, each having a tip welded thereto in which the residual stress of a spark-discharge-gap-forming surface (hereinafter will be referred to as "opposite end surface") was varied. Each sample was subjected to a vibration resistance evaluation test. The vibration resistance evaluation test was carried out as follows. Specifically, by means of a specific ultrasonic horn, vibration (frequency: 27.3 kHz) was applied for 10 hours to a surface of a sample opposite a portion to which the tip had been welded. After the elapse of 10 hours, the tip was observed for determining whether or not cracking occurred on the opposite end surface of the tip. A sample in which no cracking occurred on the tip was evaluated "Good" because the tip exhibits good vibration resistance. In contrast, a sample in which cracking occurred on the tip was evaluated "Poor" because the tip exhibits poor vibration resistance. Table 2 shows the residual stress in the opposite end surface of the tip of each sample, as well as the results of the test.

In Table 2, a negative value of residual stress corresponds to the case where compressive stress remained in the opposite end surface of the tip, whereas a positive value of residual stress corresponds to the case where tensile stress remained in the opposite end surface of the tip. A tip in which tensile stress remained in the opposite end surface was provided, and the residual stress in the opposite end surface of the tip was varied by controlling a load or a current applied to the tip upon welding of the tip to the ground electrode. Residual stress was measured by means of an X-ray residual stress measuring apparatus based on X-ray diffractometry.

TABLE 2

| Sample No. | Residual Stress (Mpa) | Evaluation |
|---|---|---|
| 1 | −220 | Good |
| 2 | −170 | Good |
| 3 | −120 | Good |
| 4 | −50 | Good |
| 5 | 0 | Poor |
| 6 | 20 | Poor |
| 7 | 100 | Poor |

As shown in Table 2, samples Nos. 1 to 4 (samples in which compressive residual stress was applied to the opposite end surface of the tip) were found to have excellent vibration resistance; i.e., no cracking occurred on the tip.

The aforementioned test data indicate that application of compressive residual stress to the opposite end surface (spark-discharge-gap-forming surface) of the tip is preferred, from the viewpoint of more reliably preventing breakage of the opposite end surface of the tip upon application of vibration thereto.

Next, a plurality of spark plug samples including ground electrodes having different hardnesses were produced, and each sample was subjected to a theoretical cooling/heating test. The theoretical cooling/heating test was carried out as follows. Specifically, a sample was subjected to 1,000 cycles of thermal treatment, each cycle including heating of the sample in an air atmosphere by means of a burner for two minutes so as to elevate the temperature of the tip to 980° C., and cooling of the sample for one minute. After completion of 1,000 cycles of thermal treatment, a cross section of the sample was observed, to thereby determine the ratio of the length of an oxide scale formed at the bonding boundary between the ground electrode and the tip to the length of the bonding boundary (hereinafter the ratio will be referred to as "oxide scale ratio"). In each sample, the tip was bonded to the ground electrode at a position 1.5 mm distant from the distal end Of the ground electrode.

In addition, the aforementioned erosion resistance evaluation test was carried out on the sample which had been subjected to the theoretical cooling/heating test.

Table 3 shows the results of both tests. The hardness of the ground electrode was varied by controlling thermal treatment conditions.

TABLE 3

| Hardness of Ground Electrode (Hv) | Oxide Scale Ratio | Gap Increase (mm) |
|---|---|---|
| 70 | 10% | 0.11 |
| 80 | 7% | 0.11 |
| 85 | 3% | 0.09 |
| 90 | 0% | 0.05 |
| 100 | 0% | 0.05 |
| 130 | 0% | 0.06 |
| 150 | 0% | 0.06 |
| 180 | 0% | 0.07 |
| 200 | 0% | 0.07 |

As shown in Table 3, it was found that, in a sample including a ground electrode having a hardness of less than 90 Hv, oxide scale is likely to be formed at the bonding boundary between the ground electrode and the tip. Conceivably, this is attributed to the fact that since the ground electrode has a relatively low hardness, small warpage occurs at an end portion of the ground electrode in association with cutting, and thus the bonding strength of the tip to the ground electrode becomes insufficient. It was also found that a sample in which oxide scale is formed at the bonding boundary between the ground electrode and the tip exhibits a relatively large gap increase in the erosion resistance evaluation test. Conceivably, this is attributed to the fact that formation of oxide scale inhibits thermal conduction from the tip to the ground electrode, and thus causes overheating of the tip.

In contrast, it was found that, in a sample including a ground electrode having a hardness of 90 Hv or more, no oxide scale is formed at the bonding boundary between the ground electrode and the tip, and that the sample exhibits excellent erosion resistance.

Figure 5:
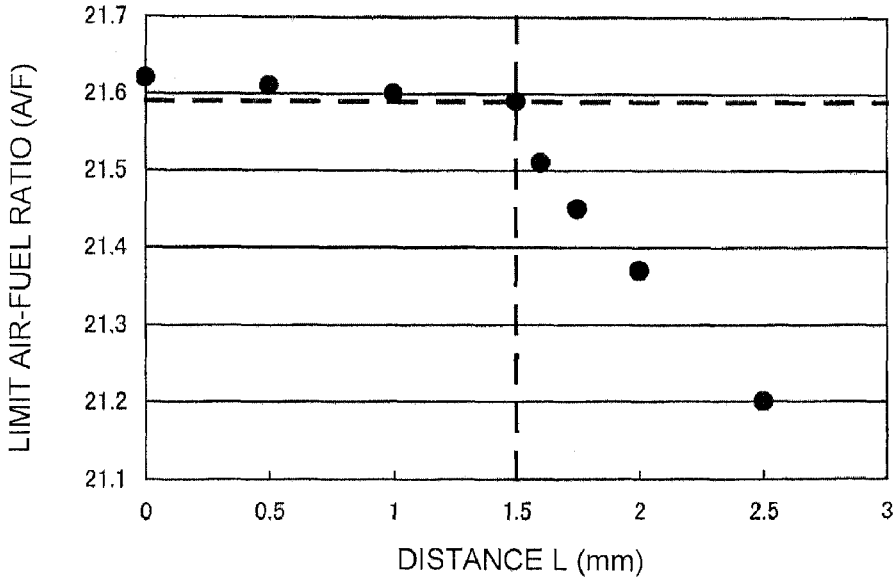
FIG. 5 is a graph showing the results of an ignition performance evaluation test performed on samples in which distance L is varied.

Next, there were produced a plurality of spark plug samples, in which the distance L, as measured along the center axis of the ground electrode, between the distal end of the ground electrode and the tip was varied. Each sample was subjected to an ignition performance evaluation test. The ignition performance evaluation test was carried out as follows. Specifically, a sample was attached to an engine (displacement: 1.5 L); spark discharge was carried out at an ignition timing of MET (minimum advance for the best torque); and the engine was operated at 1,600 rpm. While the air-fuel ratio was gradually increased (the amount of the fuel was reduced), the percent change in engine torque was measured at different air-fuel ratios, and the air-fuel ratio where the percent change in engine torque exceeds 5% was specified as "limit air-fuel ratio." The greater the limit air-fuel ratio, the more excellent the ignition performance. FIG. 5 shows the results of the test.

As shown in FIG. 5, a sample in which the distance L was 1.5 mm or less was found to exhibit further increased limit air-fuel ratio and excellent ignition performance, as compared with a sample in which the distance L is more than 1.5 mm. Conceivably, this is attributed to the fact that inhibition of flame kernel growth by the ground electrode is suppressed by reducing the distance L.

The aforementioned test data indicate that when the distance between the distal end of the ground electrode and the tip is adjusted to 1.5 mm or less for the purpose of improving ignition performance, the hardness of the ground electrode is more preferably adjusted to 90 Hv or more, from the viewpoints of inhibition of formation of oxide scale at the bonding boundary between the ground electrode and the tip, as well as further improvement of the erosion resistance of the tip.

Next, a number of spark plug samples including ground electrodes having different hardnesses were provided, and samples including ground electrodes having the same hardness were subjected to the aforementioned bending step. The number of bending cycles until breakage occurred at a supporting jig for supporting the ground electrode (hereinafter will be referred to as "number at breakage") was measured at different ground electrode hardnesses. A sample in which the number at breakage exceeded 200,000 (i.e., upper limit) was evaluated "Excellent" because it exhibits excellent productivity, whereas a sample in which the number at breakage was 150,000 or more and less than 200,000 was evaluated "Good" because it exhibits good productivity. In contrast, a sample in which the number at breakage was less than 150,000 was evaluated "Poor" because it exhibits poor productivity. Table 4 shows the results of the test.

TABLE 4

| Hardness of Ground Electrode (Hv) | Number at Breakage | Evaluation of Productivity |
|---|---|---|
| 70 | 200000 or more | Excellent |
| 80 | 200000 or more | Excellent |
| 85 | 200000 or more | Excellent |
| 90 | 200000 or more | Excellent |
| 100 | 200000 or more | Excellent |
| 130 | 200000 or more | Excellent |
| 150 | 200000 or more | Excellent |
| 180 | 180000 | Good |
| 200 | 160000 | Good |

As shown in Table 4, it was found that when the hardness of the ground electrode was adjusted to 150 Hv or less, the number at breakage exceeded 200,000, and excellent productivity was achieved.

The aforementioned test data indicate that, from the viewpoint of improvement of productivity, the hardness of the ground electrode is preferably adjusted to 150 Hv or less.

Figure 6:
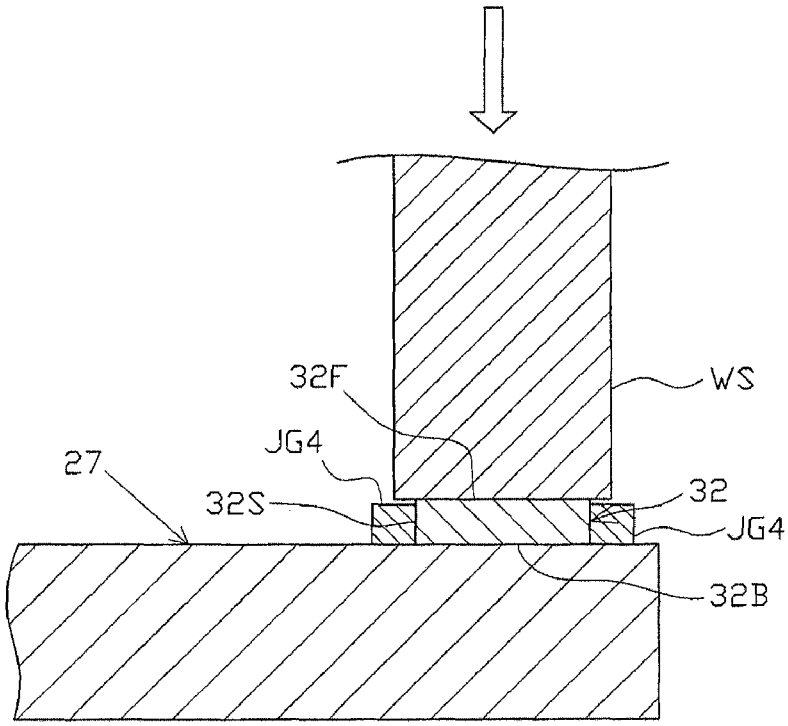
FIG. 6 is an enlarged schematic cross-sectional view of a jig, etc. for describing welding method A.

Next, a tip was bonded to a ground electrode through resistance welding as follows. As shown in FIG. 6, the side surface of the tip was supported by means of a metallic jig JG4, and electricity was applied to the tip (welding method A; corresponding to Comparative Examples). Alternatively, the side surface of the tip was exposed to air without being supported by means of the jig, and electricity was applied to the tip (welding method B; corresponding to Examples). Five samples were prepared through each welding method, and the hardness of the tip of each sample was measured after bonding of the tip to the ground electrode. Table 5 shows the hardnesses of the tips bonded to the corresponding ground electrodes through each welding method. The hardness of each tip was adjusted to 200 Hv to 260 Hv before bonding. The hardness of each tip was measured at a center portion of a cross section of the tip including the center axis thereof.

TABLE 5

| No. | Welding Method A (Hv) | Welding Method B (Hv) |
|---|---|---|
| 1 | 182 | 107 |
| 2 | 197 | 131 |
| 3 | 201 | 120 |
| 4 | 193 | 123 |
| 5 | 172 | 110 |

As shown in Table 5, it was found that when a tip was bonded through welding method B, the hardness of the tip was sufficiently lowered. Conceivably, this is attributed to the fact that since the side surface of the tip is exposed to air without being supported by means of the jig, heat is less likely to be released from the tip during welding, and the tip is sufficiently heated.

The aforementioned test data indicate that, in order to lower the hardness of a tip more reliably without providing any particular processing step, preferably, upon resistance welding, electricity is applied to the tip while the side surface of the tip is not supported, but are exposed to air.

The present invention is not limited to the above-described embodiment, but may be embodied, for example, as follows. Needless to say, applications and modifications other than those exemplified below are also possible.

(a) In the above-described embodiment, the tip 32 or the ground electrode 27 is formed of a metallic material containing Si, Mn, and Al. However, the tip 32 or the ground electrode 27 may be formed of a metallic material containing at least one species of Si, Mn, and Al. The tip 32 or the ground electrode 27 may be formed of a metallic material not containing Si, Mn, or the like. When the tip 32 or the ground electrode 27 is formed of a metallic material containing Si, Mn, or the like, the amount of such an element may be appropriately varied.

(b) In the above-described embodiment, each of the tip 32 and the ground electrode 27 contains a rare earth element. However, at least one of the tip 32 and the ground electrode 27 does not necessarily contain a rare earth element.

(c) In the above-described embodiment, the hardness of the tip 32 is adjusted at the time when the tip 32 is bonded to the ground electrode 27. However, the hardness of the tip 32 may be adjusted through thermal treatment of the tip 32 before or after bonding of the tip 32 to the ground electrode 27.

(d) In the above-described embodiment, the spark discharge gap 33 is formed between the center electrode 5 and the tip 32. However, a noble metal tip formed of a noble metal alloy (e.g., platinum alloy or iridium alloy) may be provided at a front end portion of the center electrode 5, and the spark discharge gap 33 may be formed between the noble metal tip and the tip 32.

(e) In the above-described embodiment, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977: 2005(E)] or the like.

DESCRIPTION OF REFERENCE NUMERALS

1: spark plug
2: insulator
3: metallic shell
4: axial hole
5: center electrode
27: ground electrode
32: tip
32F: end surface
33: spark discharge gap (gap)
CL1: axis
JG1: supporting jig.

We claim:

1. A spark plug comprising:

a tubular insulator having an axial hole extending therethrough in a direction of an axis;

a center electrode inserted into the axial hole at a front end thereof;

a tubular metallic shell provided around the insulator;

a ground electrode whose proximal end portion is fixed to a front end portion of the metallic shell; and a tip which is bonded to a distal end portion of the ground electrode such that a gap is formed between the tip and a front end portion of the center electrode, wherein the tip is formed of a metallic material containing nickel in an amount of 93 mass % or more; and the tip has a Vickers hardness of 163 Hv or less.

2. The spark plug according to claim 1, wherein compressive residual stress is applied to a surface of the tip, the surface forming the gap.

3. The spark plug according to claim 1, wherein a distance, as measured along the center axis of the ground electrode, between the distal end of the ground electrode and the tip is adjusted to 1.5 mm or less; and the ground electrode has a Vickers hardness of 90 Hv or more.

4. The spark plug according to claim 1, wherein the ground electrode is formed of a metallic material containing nickel as a main component; and at least one of the tip and the ground electrode contains at least one species selected from among silicon, manganese, and aluminum.

5. The spark plug according to claim 1, wherein the ground electrode is formed of a metallic material containing nickel as a main component; and at least one of the tip and the ground electrode contains silicon in an amount of 0.5 mass % to 1.3 mass %, manganese in an amount of 0.1 mass % to 1.1 mass %, and aluminum in an amount of 0.01 mass % to 1.00 mass %.

6. The spark plug according to claim 1, wherein at least one of the tip and the ground electrode contains one or more rare earth elements.

7. The spark plug according to claim 6, wherein the total amount of the rare earth element(s) is 0.05 mass % to 0.25 mass %.

8. The method for producing a spark plug as recited in claim 1, characterized by comprising:

a bonding step of bonding the tip to the ground electrode through resistance welding, wherein, in the bonding step, the tip is bonded to the ground electrode by bringing one end surface of the tip into contact with the ground electrode, and applying electricity to the tip while applying pressure to the tip from a side of an opposite end surface toward the ground electrode; and a side surface of the tip located between the one end surface and the opposite end surface is exposed to air at least during application of electricity to the tip.

9. The method for producing a spark plug according to claim 8, wherein the tip has a Vickers hardness of 100 Hv or more as measured after the bonding step.

10. The method for producing a spark plug according to claim 8, which further comprises a bending step of bending the ground electrode by supporting, with a rod-like supporting jig, a surface of the ground electrode on the side of the center electrode, and pressing the ground electrode from the surface opposite the surface on the side of the center electrode, wherein the ground electrode has a Vickers hardness of 150 Hv or less.

* * * * *